US009445484B2

(12) United States Patent
Yoneoka et al.

(10) Patent No.: US 9,445,484 B2
(45) Date of Patent: Sep. 13, 2016

(54) MULTI-SCREEN DISPLAY APPARATUS AND LUMINANCE CONTROL METHOD

(71) Applicants: Isao Yoneoka, Tokyo (JP); Yoshinori Asamura, Tokyo (JP); Takashi Matoba, Tokyo (JP)

(72) Inventors: Isao Yoneoka, Tokyo (JP); Yoshinori Asamura, Tokyo (JP); Takashi Matoba, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 472 days.

(21) Appl. No.: 13/706,000

(22) Filed: Dec. 5, 2012

(65) Prior Publication Data

US 2013/0200821 A1 Aug. 8, 2013

(30) Foreign Application Priority Data

Feb. 7, 2012 (JP) ..... 2012-023692

(51) Int. Cl.
*H05B 37/02* (2006.01)
*H05B 37/03* (2006.01)
*H05B 33/08* (2006.01)

(52) U.S. Cl.
CPC ..... *H05B 37/03* (2013.01); *H05B 33/0827* (2013.01); *H05B 33/0893* (2013.01)

(58) Field of Classification Search
USPC ..... 315/297
See application file for complete search history.

(56) References Cited

U.S. PATENT DOCUMENTS

| | | | | |
|---|---|---|---|---|
| 8,339,355 | B2 | 12/2012 | Segawa et al. | |
| 8,810,478 | B2 | 8/2014 | Asamura et al. | |
| 2009/0085489 | A1* | 4/2009 | Chang et al. | 315/193 |
| 2010/0283720 | A1 | 11/2010 | Segawa et al. | |
| 2011/0095965 | A1* | 4/2011 | Yoneoka et al. | 345/1.1 |
| 2011/0181565 | A1 | 7/2011 | Asamura et al. | |

FOREIGN PATENT DOCUMENTS

| | | | |
|---|---|---|---|
| CN | 102054451 | A | 5/2011 |
| JP | 2008-151838 | A | 7/2008 |
| JP | 2008-185924 | A | 8/2008 |
| JP | 2011-154174 | A | 8/2011 |
| WO | WO 2009/118975 | A1 | 10/2009 |

* cited by examiner

*Primary Examiner* — Lincoln Donovan
*Assistant Examiner* — Patrick Chen
(74) *Attorney, Agent, or Firm* — Birch, Stewart, Kolasch & Birch, LLP

(57) ABSTRACT

In the case where luminance of light to be irradiated onto a multi-screen is not homogenized over the entire multi-screen, each of an image display apparatus and image display apparatuses carries out a homogenizing process of light to be irradiated onto a multi-screen over the entire multi-screen.

6 Claims, 5 Drawing Sheets

MULTI-SCREEN DISPLAY APPARATUS AND LUMINANCE CONTROL METHOD

BACKGROUND OF THE INVENTION

1. Field of the Invention

The present invention relates to a multi-screen display apparatus that displays an image on a multi-screen constituted by a plurality of screens and a luminance control method.

2. Description of the Background Art

In recent years, in a projection-type image display apparatus, light sources utilizing light emitting diodes (LED (Light Emitting Diodes)) have been used in place of conventional lamp light sources. In particular, in a display apparatus of DLP (registered trade mark) (Digital Light Processing) system that uses DMD's (Digital Micromirror Devices), LED's that emit red light, LED's that emit green light and LED's that emit blue light are used. In the display apparatus of the DLP (registered trade mark) system, these LED's of three colors are lit up on in a time sharing manner.

As the projection-type image display apparatus utilizing LED's as light sources, those using LED arrays constituted by a plurality of LED's have been proposed in order to improve luminance of light sources. In the following description, the LED array that emits red light is referred to also as an R-LED array. Moreover, the LED array that emits green light is referred to also as a G-LED array. In the following description, the LED array that emits blue light is referred to also as a B-LED array.

In these projection-type image display apparatuses, a driving circuit is installed for each of LED's forming an LED array or for each group of a plurality of sets of LED's. More specifically, with respect to the former, for example, each R-LED array includes six LED's. In the six LED's, six driving circuits are respectively installed. With respect to the latter, for example, a structure is proposed in which a driving circuit is installed for each of three sets of LED groups. Each of the LED groups is constituted by, for example, two LED's.

Moreover, in recent years, also in a multi-screen display apparatus that is constituted by a plurality of projection-type image display apparatuses and displays an image on a multi-screen including a plurality of screens, those using LED's as light sources respectively for RGB have been proposed. The multi-screen display apparatus includes a projection-type image display apparatus that displays an image on a screen by projecting an image from the rear face side of the screen.

As the image display apparatus using a plurality of LED's, those utilizing a technique for controlling the quantity of light emission of the light source by controlling the current value of an electric current to be supplied to each LED has been proposed (for example, see Patent Document 1 (Japanese Patent Application Laid-Open No. 2008-185924).

In the multi-screen display apparatus, however, the following problems have been raised.

For example, in the case where one of LED's inside the R-LED array has a failure with the result that the corresponding LED becomes incapable of being lit up, the driving circuit with the failed LED stops the driving operation of the LED. In this case, the image projected on the screen has a reduction in luminance of red color. Consequently, the chromaticity of an image displayed on the multi-screen is also changed.

In particular, in the case of the multi-screen display apparatus constituted by a plurality of image display apparatuses, due to a change of luminance or the like of a certain image display apparatus, homogeneity in luminance among the respective screens on the multi-screen is impaired.

SUMMARY OF THE INVENTION (Object)

The object of the present invention is to provide a multi-screen display apparatus, etc. that can maintain homogeneity of luminance among respective screens in a multi-screen.

(Constitution: Corresponding to Claim 1)

A multi-screen display apparatus in accordance with one aspect of the present invention is a multi-screen display apparatus that includes a first image display apparatus having a first screen and serving as a master apparatus and one or more second image display apparatuses, each having one of second screens and serving as a slave apparatus, and displays an image on a multi-screen constituted by the first screen and one or more the second screens. In the multi-screen display apparatus, each of the first image display apparatus and the one or more second image display apparatuses is provided with: an array light source including a plurality of light emitting elements for emitting light to be irradiated onto the multi-screen so as to display an image on the multi-screen; a light source control unit that controls the plurality of light emitting elements so as to emit light; and a failure determination unit that determines whether or not there is a failure light emitting element that is a light emitting element having a failure among the plurality of light emitting elements, and in this structure, in the case where there is the failure light emitting element, the light source control unit carries out a light correction process for controlling the light emitting elements except for the failure light emitting element among the plurality of light emitting elements so as to allow luminance of light to be emitted by the array light source including the failure light emitting element to become closer to luminance of light emitted by the array light source prior to the occurrence of the failure light emitting element, and in the case where the light correction process is carried out, the second image display apparatus transmits correction information relating to the light correction process to the first image display apparatus, and in the case where the first image display apparatus carries out the light correction process or the case where the first image display apparatus receives correction information from the second image display apparatus, the first image display apparatus forms a correction instruction for use in homogenizing luminance of light to be irradiated to the multi-screen over the entire portion of the multi-screen, based upon at least one correction information relating to the light correction process carried out by the first image display apparatus and the received correction information, and in the case where luminance of light to be irradiated to the multi-screen is not homogenized over the entire multi-screen, each of the first image display apparatus and the second image display apparatuses carries out a process for homogenizing luminance of light to be irradiated to the multi-screen over the entire multi-screen in accordance with the correction instruction.

(Effect)

In accordance with the present invention, in the case where luminance of light to be irradiated to the multi-screen is not homogenized over the entire multi-screen, each of the first image display apparatus and the second image display apparatuses carries out a process for homogenizing luminance of light to be irradiated to the multi-screen over the entire multi-screen. Thus, it is possible to provide a multi-screen display apparatus that can maintain homogeneity of luminance among respective screens in a multi-screen.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
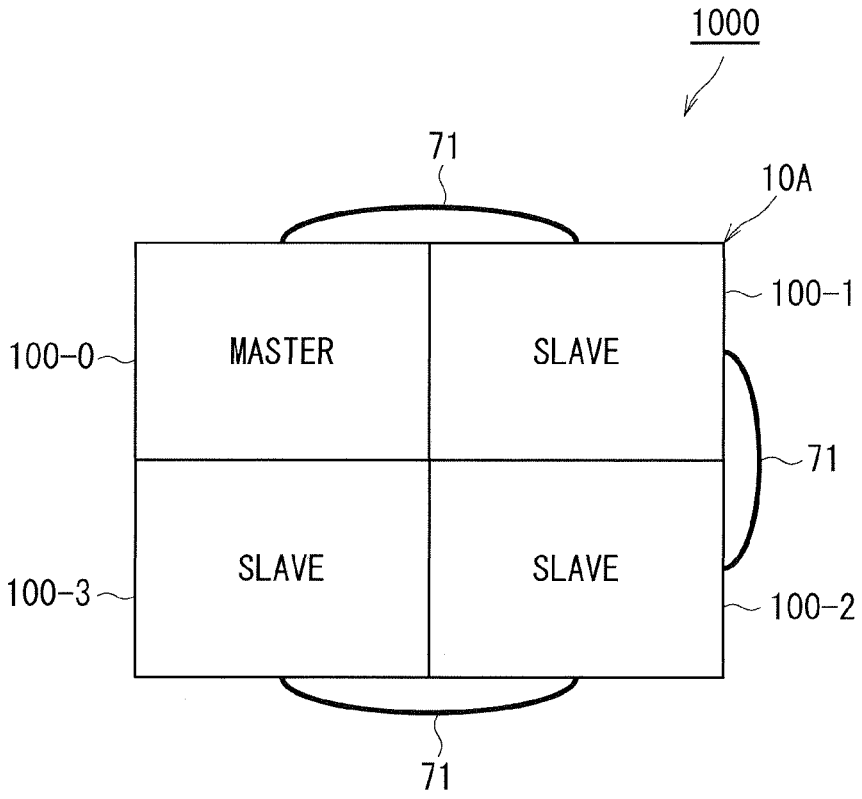
FIG. 1 is a view showing a structure of a multi-screen display apparatus in accordance with a preferred embodiment of the present invention.

Referring to drawings, the following description will explain a preferred embodiment of the present invention. In the following explanation, the same components are indicated by the same reference numerals. The names and functions thereof are the same. Therefore, the detailed explanation thereof will be sometimes omitted.

FIG. 1 is a view showing a structure of a multi-screen display apparatus 1000 in accordance with the preferred embodiment of the present invention. The multi-screen display apparatus 1000 is an image display apparatus (multi-vision) of a projection type that projects an image on the screen.

As shown in FIG. 1, the multi-screen display apparatus 1000 includes image display apparatuses 100-0, 100-1, 100-2 and 100-3. The respective image display apparatuses 100-0, 100-1, 100-2 and 100-3 the detailed descriptions of which will be given later have the same structure. In the following description, each of the image display apparatuses 100-0, 100-1, 100-2 and 100-3 is also referred to simply as an image display apparatus 100.

The image display apparatus 100-0 functions as a master apparatus in the multi-screen display apparatus 1000. In the following description, the image display apparatus 100-0 is also referred to as a master apparatus. The respective image display apparatuses 100-1, 100-2 and 100-3 are also referred to as slave apparatuses in the multi-screen display apparatus 1000. In this case, the number of the slave apparatuses included in the multi-screen display apparatus 1000 is not limited to three, and may be 1 to 3, or 4 or more. That is, the multi-screen display apparatus 1000 includes a first image display apparatus (master apparatus) having a first screen and one or more second image display apparatuses (slave apparatuses) having second screens.

The image display apparatus 100-0 is capable of communicating with the respective image display apparatuses 10-0, 10-1, 10-2 and 10-3 serving as slave apparatuses by utilizing communication cables 71.

Figure 2:
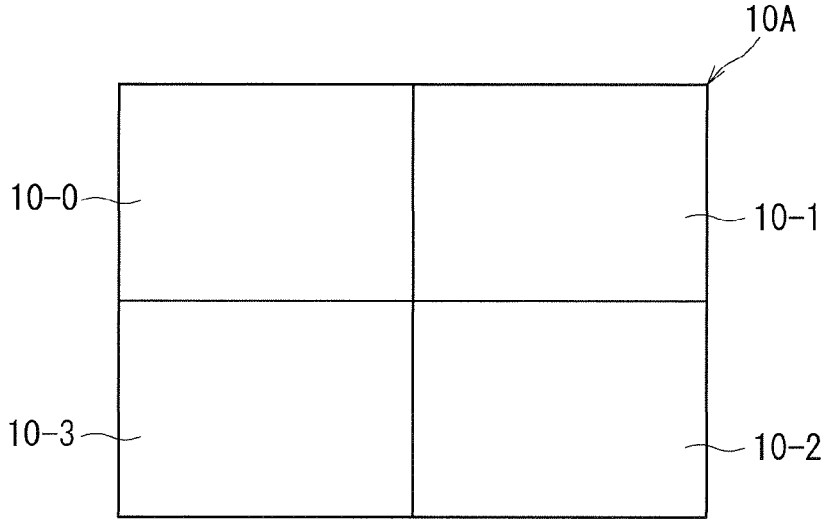
FIG. 2 is a view explaining a structure of a multi-screen.

The image display apparatuses 100-0, 100-1, 100-2 and 100-3 respectively include screens 10-0, 10-1, 10-2 and 10-3 as shown in FIG. 2.

The multi-screen display apparatus 1000 includes a multi-screen 10A. As shown in FIG. 2, the multi-screen 10A forms a single screen constituted by screens 10-0, 10-1, 10-2 and 10-3 that are arranged in a matrix. In the following description, each of the screens 10-0, 10-1, 10-2 and 10-3 is also referred to simply as a screen 10. Onto the screen 10, light for use in forming an image is irradiated.

Additionally, the number of the screens forming the multi-screen 10A is not limited by four, and may be set to 2, 3 or 5 or more. That is, the multi-screen 10A is constituted by the first screen (screen 10 of the master apparatus) and one or more second screens (screens 10 of the slave apparatuses).

The multi-screen display apparatus 1000 displays an image on the multi-screen 10A by allowing the respective image display apparatuses 100 to display images on the screens 10.

Figure 3:
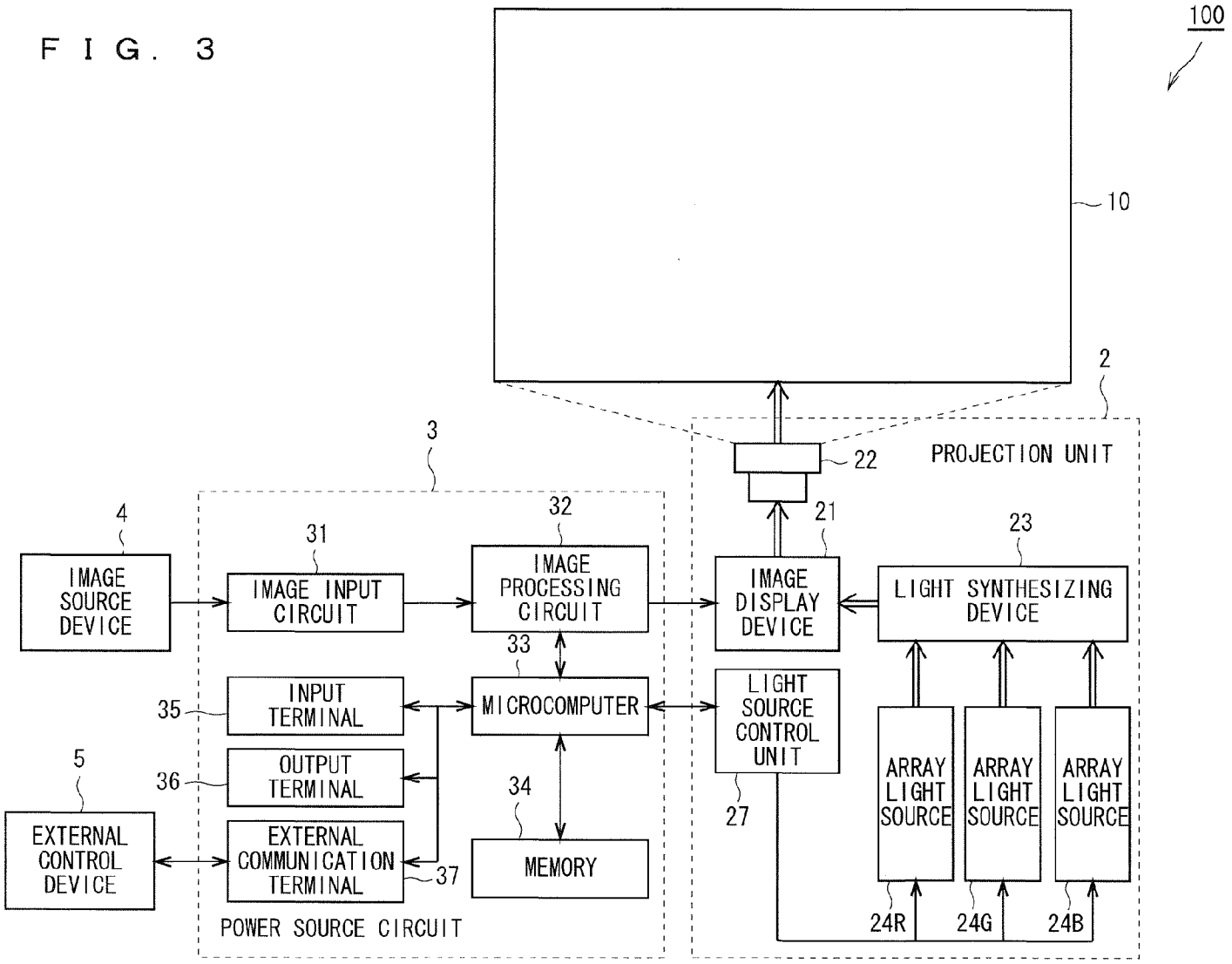
FIG. 3 is a block diagram showing a structure of an image display apparatus.

FIG. 3 is a block diagram showing a structure of the image display apparatus 100 serving as the master apparatus or the slave apparatus. Additionally, FIG. 3 also shows an image source device 4 and an external control device 5, which are not included in the image display apparatus 100.

As shown in FIG. 3, the image display apparatus 100 includes a screen 10, a projection unit 2 and a power source circuit 3.

The projection unit 2 includes an image display device 21, a projection lens 22, a light synthesizing device 23, array light sources 24R, 24G and 24B and a light source control unit 27.

The image display device 21 is prepared as, for example, a DMD. That is, each of the image display apparatuses 100 is a device of a single plate system in which a single DMD is utilized. Additionally, the image display device 21 is not limited by the DMD, and may be prepared as another image display device.

An array light source 24R is a red light source that emits red light. An array light source 24G is a green light source that emits green light. An array light source 24B is a blue light source that emits blue light. Thus, array light sources constituted by the array light sources 24R, 24G and 24B include a red light source, a green light source and a blue light source.

In the following description, each of the array light sources 24R, 24G and 24B is also referred to simply as an array light source 24.

In the following description, red, green and blue colors are also indicated by R, G and B respectively. Moreover, in the following description, red light, green light and blue light are also indicated by R-light, G-light and B-light respectively. Moreover, in the following description, luminance of red light, luminance of green light and luminance of blue light are also indicated by R-luminance, G-luminance and B-luminance respectively.

Figure 4:
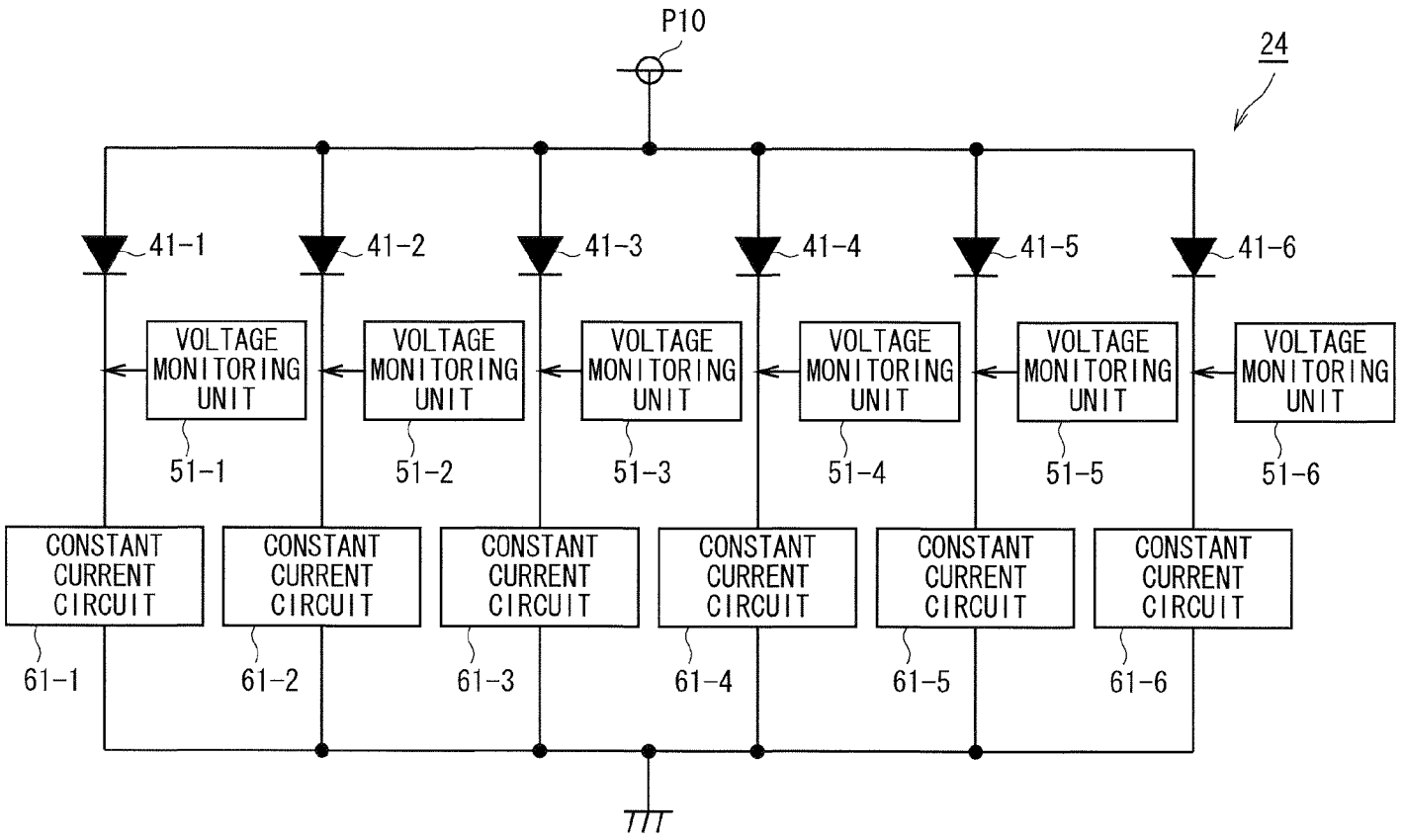
FIG. 4 is a view showing a structure of array light sources.

FIG. 4 is a view showing a structure of the array light source 24.

As shown in FIG. 4, the array light source 24 includes light emitting elements 41-1, 41-2, 41-3, 41-4, 41-5 and 41-6. The light emitting elements 41-1, 41-2, 41-3, 41-4, 41-5 and 41-6 are respectively prepared as LED's. For example, the light emitting element 41-1 is allowed to emit light when a current flows through the light emitting element 41-1.

In this case, it is supposed that the respective operational characteristics of the light emitting elements 41-1, 41-2, 41-3, 41-4, 41-5 and 41-6 are the same. In the following description, each of the light emitting elements 41-1,41-2, 41-3, 41-4, 41-5 and 41-6 is also referred to simply as a light emitting element 41.

That is, each of the array light sources 24R, 24G and 24B includes a plurality of light emitting elements 41. The light emitting elements 41 included in the array light source 24R are elements (hereinafter, referred to also as light emitting elements R) that emit red light. The light emitting elements 41 included in the array light source 24G are elements (hereinafter, referred to also as light emitting elements G) that emit green light. The light emitting elements 41 included in the array light source 24B are elements (hereinafter, referred to also as light emitting elements B) that emit blue light. The respective light emitting elements 41 emit light rays to be irradiated onto the multi-screen 10A so as to display an image on the multi-screen 10A.

The number of the light emitting elements 41 included in each of the array light sources 24 is not limited by 6, and may be set to 2 to 5, or 7 or more. Moreover, the light emitting elements 41 are not limited by LED's and other light emitting elements may be used.

In the image display apparatus using a single image display device 21 serving as a DMD, since detailed processes for use in displaying an image are known processes, the detailed description thereof will be omitted. The explanation thereof is briefly given below.

A light source control unit 27 carries out a controlling process so as to allow the plurality of light emitting elements 41 of the respective array light sources 24 to emit light. More specifically, in accordance with an instruction from a microcomputer 33, which will be described later, the light source control unit 27 controls the array light sources 24R, 24G and 24B so as to sequentially emit red light, green light and blue light in different timings (in a time sharing manner).

The light synthesizing device 23 sequentially releases the red light, green light and blue light emitted from the array light sources 24R, 24G and 24B.

After having been irradiated onto the image display deice 21 through the light synthesizing device 23, light rays respectively released from the array light sources 24R 24G and 24B are irradiated onto the screen 10 through the projection lens 22. Additionally, a red light ray, a green light ray and a blue light ray are sequentially irradiated onto the screen 10 with very short time intervals. For this reason, to the user who is viewing the screen 10, the screen 10 is appeared as if the screen 10 was irradiated with synthesized light of the red light ray, green light ray and blue light ray. That is, the user views a mixed color of red, green and blue on the screen 10. Thus, an image is displayed on the screen 10.

The image display device 21 modulates the intensity of light irradiated thereon in accordance with an image signal to be described later, which is received from the image processing circuit 32, and directs the resulting modulated light to the projection lens 22.

The power source circuit 3 includes an image input circuit 31, the image processing circuit 32, a microcomputer 33, a memory 34, an input terminal 35, an output terminal 36 and an external communication terminal 37.

The image input circuit 31 receives an image signal outputted from the image source device 4 disposed outside the multi-screen display apparatus 1000. Next, the image input circuit 31 outputs an image signal converted into a digital signal to the image processing circuit 32.

The image processing circuit 32 carries out image treatment processes, such as image quality adjustments, etc., on an image represented by the received image signal. Next, the image processing circuit 32 converts the image signal that has been image-treated to an image signal having a format that can be processed by the image display device 21. Moreover, the image processing circuit 32 outputs the converted image signal to the image display device 21 at a timing in accordance with an instruction from the microcomputer 33. For example, the image processing circuit 32 outputs the converted image signal representing an image forming a red component to the image display device 21 at a synchronized timing with the projection of a red light ray onto the image display device 21.

The image signal processing circuit 32 has such a function as to increase or reduce the signal level of the entire screen 10 independently for each of the red light ray, green light ray and blue light ray so that chromaticity and luminance levels among the respective screens 10 of the multi-screen 10A are adjusted.

The input terminal 35 and output terminal 36 are connected to another image display apparatus 100 through communication cables 71.

The microcomputer 33 is controlled through the external communication terminal 37 by the external control device 5 installed outside the multi-screen display apparatus 1000. Moreover, the microcomputer 33 controls communications among the respective image display apparatuses 100 through the input terminal 35 and the output terminal 36.

Moreover, the microcomputer 33 controls the luminance of light emitted by the respective array light sources 24R, 24G and 24B by using the light source control unit 27.

The microcomputer 33 allows the memory 34 to store various control data including a current-luminance characteristic and an image quality adjustment value of the image processing circuit 32, which will be described later. The image quality adjustment value is an adjusted value of luminance, chromaticity, or the like of RGB. Moreover, the microcomputer 33 reads the current-luminance characteristic, various data, etc. stored in the memory 34, if necessary.

The following description will describe one example of the array light source 24.

As shown in FIG. 4, the array light source 24 includes the aforementioned light emitting elements 41-1, 41-2, 41-3, 41-4, 41-5 and 41-6, a power source P10, constant current circuits 61-1, 61-2, 61-3, 61-4, 61-5 and 61-6, and voltage monitoring units 51-1, 51-2, 51-3, 51-4, 51-5 and 51-6. In the following description, each of the constant current circuits 61-1, 61-2, 61-3, 61-4, 61-5 and 61-6 is also referred to simply as a constant current circuit 61. Moreover, in the following description, each of the voltage monitoring units 51-1, 51-2, 51-3, 51-4, 51-5 and 51-6 is also referred to simply as a voltage monitoring unit 51.

The constant current circuits 61-1, 61-2, 61-3, 61-4, 61-5 and 61-6 are electrically connected to the light emitting elements 41-1, 41-2, 41-3, 41-4, 41-5 and 41-6, respectively. That is, the constant current circuits 61 are installed in association with the respective light emitting elements 41. To each of the light emitting elements 41-1, 41-2, 41-3, 41-4, 41-5 and 41-6, for example, a voltage of 12V is applied from the power source P10.

Each of the six constant current circuits 61 is a circuit used for allowing a constant current to flow through the corresponding light emitting element 41.

The light source control unit 27 controls the constant current circuit 61 so that light emission of the light emitting element 41 corresponding to the constant current circuit 61 is controlled. More specifically, in accordance with an instruction from the microcomputer 33, the light source control unit 27 controls each constant current circuit 61 so as to change the amount of an electric current flowing through each of the constant current circuits 61 of the array light source 24, if necessary. Thus, a constant current is allowed to flow through each of the light emitting elements 41. In other words, by driving each light emitting element 41 with the constant current, the light source control unit 27 allows each of the light emitting elements 41 to emit light so that the luminance control of each light emitting element 41 is carried out.

Additionally, at the time of the initial adjustment, the respective light emitting elements 41 of the same array light source 24 are driven by electric currents having the same current value.

In this case, with respect to each of the image display apparatuses 100, a measurer preliminarily carries out an operation on the external control device 5 so as to irradiate only any one of the red light, green light and blue light to the multi-screen 10A. Additionally, the measurer also carries out an operation for specifying the current value of an electric current to be utilized for the light projection on the external control device 5.

More specifically, by the control from the external control device 5 operated by the measurer with respect to each of the image display apparatuses 100, the light source control unit 27 of each of the image display apparatuses 100 controls each of the constant current circuits 61 relating to only any one of the array light sources 24R, 24G and 24B so that a predetermined electric current is allowed to flow through the corresponding ones of the light emitting elements 41.

Moreover, the measurer measures the luminance of light (for example, red light) irradiated onto the multi-screen 10A based upon an electric current flowing through each of the light emitting elements 41 by using a measuring device, etc. The measurer divides the measured luminance by the number of the light emitting elements 41 forming the array light source 24 so that the luminance of light emitted by one light emitting element 41 is calculated.

In this case, when measuring the luminance of light, the light emitted by the light emitting elements 41 is prevented from being intensity-modulated by the image display device 21 or the like. That is, when measuring the luminance of light, it is supposed that the light emitted from the light emitting elements 41 is irradiated onto the multi-screen 10A without being intensity-modulated.

The measurer preliminarily calculates a current-luminance characteristic that is a characteristic relating to luminance of light emitted by one light emitting element 41 relative to a current flowing through the above-mentioned one light emitting element 41. In other words, the current-luminance characteristic corresponds to a characteristic indicating a relationship between the current flowing through the light emitting element 41 and the luminance of light emitted from the light emitting element 41.

The calculation of the current-luminance characteristic is carried out on each of the red light, green light and blue light.

The respective image display apparatuses 100 preliminarily store the calculated current-luminance characteristic of each of the red light, green light and blue light in the memory 34.

Figure 5:
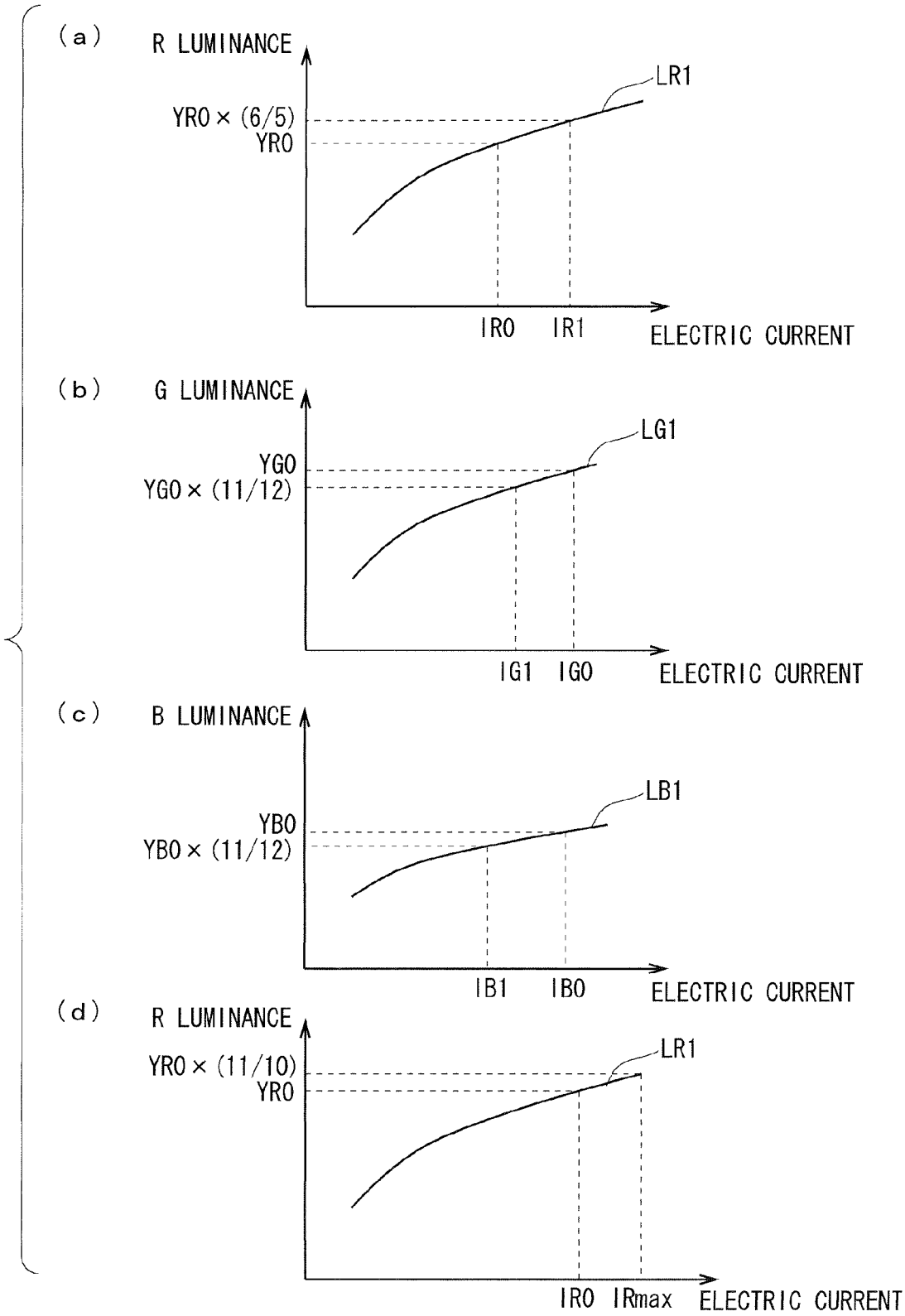
FIG. 5 is a view showing one example of a current-luminance characteristic.

FIG. 5 is a view showing one example of a current-luminance characteristic. Part (a) in FIG. 5 is a view showing one example of current-luminance characteristic LR1 of a single light emitting element R that emits red light. In part (a) in FIG. 5, YR0 refers to the initial luminance of light emitted by the corresponding light emitting element R in the case where the current value of a current flowing through the light emitting element R is IR0.

In the case where all the six light emitting elements 41 included in the array light source 24R emit light and the current value is set to IR0, the luminance of light emitted by the array light source 24R is represented by 6×YR0.

Part (b) in FIG. 5 is a view showing one example of current-luminance characteristic LG1 of a single light emitting element 41 that emits green light. IG0 refers to a current value of an electric current that has been adjusted by processes, which will be described later. YG0 refers to the initial luminance of light emitted by the corresponding light emitting element G in the case where the current value of a current flowing through the light emitting element G is IG0.

Part (c) in FIG. 5 is a view showing one example of current-luminance characteristic LB1 of a single light emitting element 41 that emits blue light. IB0 refers to a current value of an electric current that has been adjusted by processes, which will be described later. YB0 refers to the initial luminance of light emitted by the corresponding light emitting element B in the case where the current value of a current flowing through the light emitting element B is IB0.

Referring again to FIG. 4, the voltage monitoring units 51-1, 51-2, 51-3, 51-4, 51-5 and 51-6 are respectively installed in association with the light emitting elements 41-1, 41-2, 41-3, 41-4, 41-5 and 41-6.

Each of the voltage monitoring units 51 measures the voltage on the output side of the corresponding light emitting element 41 on demand, and transmits the measured voltage to the microcomputer 33 through the light source control unit 27. With this arrangement, the microcomputer 33 is allowed to confirm the state of each of the light emitting elements 41 on demand.

The light emitting elements 41 have different voltage drops depending on a color to be emitted and a current amount. For example, in the case where a voltage drop is 3 to 5V at the time of normal operation of the light emitting element R, the voltage to be detected by the voltage monitoring units 51 is 7 to 9V.

Here, for example, a range within which the light emitting element R is determined as being normally operated is set to 7 to 9V. In this case, when receiving a voltage of 9V or more from the voltage monitoring unit 51, the microcomputer 33 determines that the light emitting element 41 corresponding to the voltage monitoring unit 51 that has transmitted the corresponding voltage has a failure in a short-circuit state. Moreover, when receiving a voltage of 9V or less from the voltage monitoring unit 51, the microcomputer 33 determines that the light emitting element 41 corresponding to the voltage monitoring unit 51 that has transmitted the corresponding voltage has a failure in an open-circuit state.

The microcomputer 33 detects a light emitting element in failure (hereinafter, referred to also as "failure light emitting element") from the respective array light sources 24R, 24G and 24B based upon the voltage received from the respective voltage monitoring units 51 through the light source control unit 27. That is, the microcomputer 33 serves as a failure determination unit that determines whether or not there is any failure light emitting element among the plurality of light emitting elements included in the respective array light sources 24. Additionally, the failure light emitting element is a light emitting element that is incapable of lighting on.

In the case where there is a failure light emitting element, a drop in luminance and a change in chromaticity occur in light to be irradiated onto the multi-screen 10A (screen 10). For example, in the case where one piece of the light emitting elements R breaks down, the drop of R luminance and the chromaticity change in white light that is a mixed color light of the RGB light rays occur.

The following description will describe processes (hereinafter, referred to also as luminance controlling processes) for correcting the drop in luminance and the change in chromaticity. As described earlier, the image display apparatus 100-0 is referred to also as the master apparatus. Moreover, as described earlier, the respective image display apparatuses 100-1, 100-2 and 100-3 are referred to also as the slave apparatuses.

Figure 6:
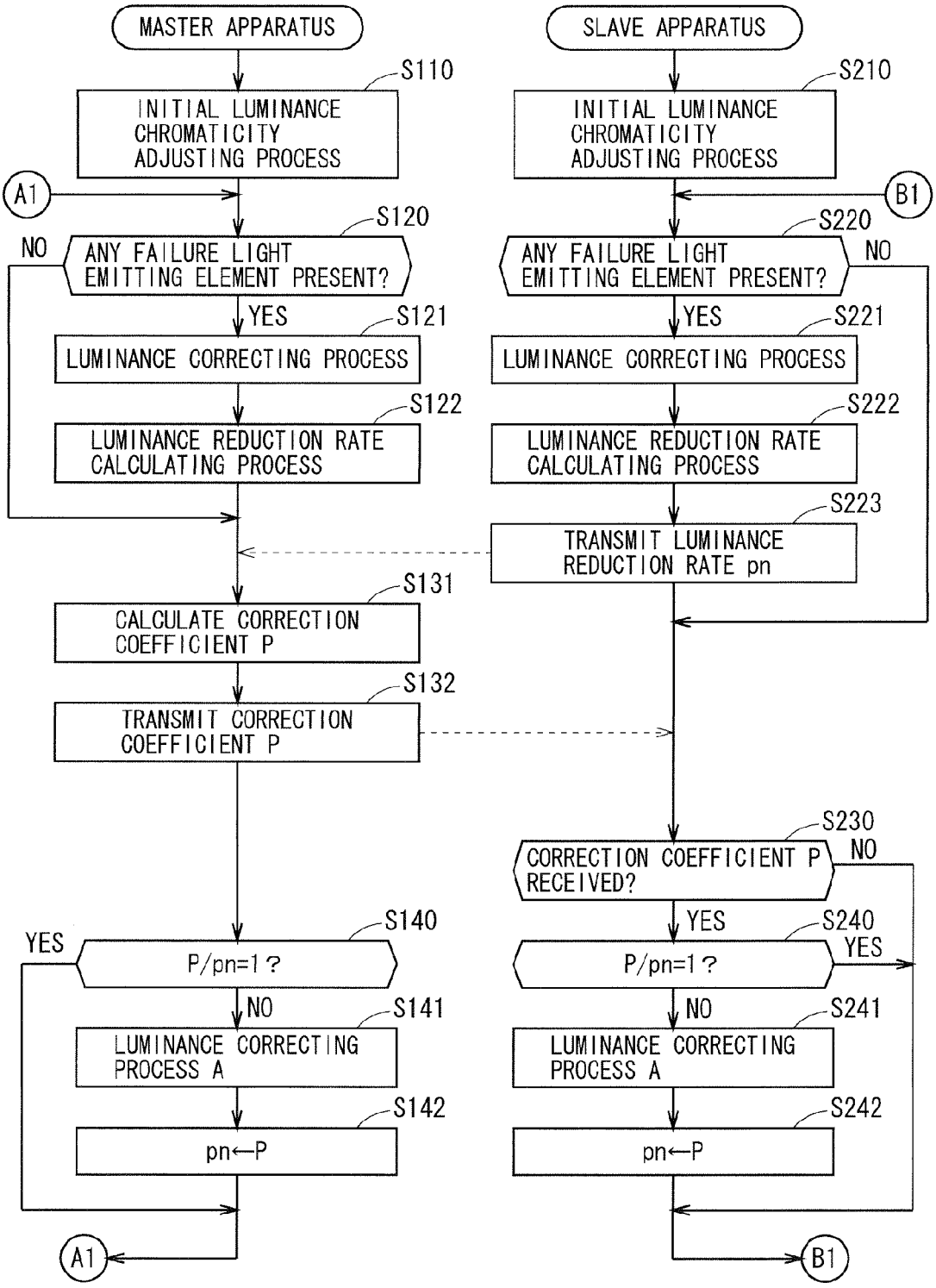
FIG. 6 is a flow chart of a luminance controlling process.

FIG. 6 is a flow chart showing luminance controlling processes.

In FIG. 6, processes in steps S110 to S142 are processes that the master apparatus carries out. Processes in steps S210 to S242 are processes that the slave apparatuses carry out. In the following processes, the light source control unit 27 carries out the processes in accordance with an instruction from the microcomputer 33.

For example, when the power source of the multi-screen display apparatus 1000 is turned on, initial luminance and chromaticity adjusting processes are carried out in each of the master apparatus and the slave apparatuses as initial setting processes (S110, S210). The initial luminance and chromaticity adjusting processes are initial processes for use in homogenizing the luminance and chromaticity of light to be irradiated onto the multi-screen 10A over the entire multi-screen 10A so as to display an image on the multi-screen 10A.

In the initial luminance and chromaticity adjusting processes, the light source control unit 27 carries out light adjustments. More specifically, the light source control unit 27 adjusts the amount of an electric current that is allowed to flow through the respective light emitting elements 41 of the respective array light sources 24 by using the respective constant current circuits 61 so as to homogenize the luminance and chromaticity of light to be irradiated to the multi-screen 10A over the entire multi-screen 10A. Moreover, the microcomputer 33 stores current values IR0, IG0 and IB0 of the adjusted currents in the memory 34.

Next, the microcomputer 33 determines whether or not any failure light emitting element is present (S120, S220).

In the case where no failure light emitting element is present (NO in S120 or S220), the process proceeds to step S131 in the master apparatus, while the process to step S230 in the slave apparatuses. In contrast, in the case where any failure light emitting element is present (YES in S120 or S220), the process proceeds to step S121 in the master apparatus, while the process proceeds to step S221 in the slave apparatuses.

In luminance correcting processes (S121 and S221), the light source control unit 27 carries out light correcting processes by using the current-luminance characteristic. The light correcting processes are processes for controlling light emitting elements except for the failure light emitting element among the plurality of light emitting elements included in the array light source 24 so as to allow the luminance of light to be emitted by the array light source 24 including the failure light emitting element to become close to the luminance of light emitted by the array light source 24 prior to the occurrence of the failure light emitting element.

More specifically, by using required pieces of information among the current-luminance characteristics of red light, green light and blue light rays and the adjusted current values IR0, IG0 and IB0 stored in the memory 34, the microcomputer 33 calculates a corrected current value for use in controlling an electric current that flows through the light emitting elements 41 having no failure. Moreover, based upon an instruction from the microcomputer 33, the light source control unit 27 varies the amount of the electric current flowing through the light emitting elements 41 that have no failure and are normally lit up by controlling the necessary constant current circuit 61 so that the luminance is corrected.

In the following description, the ratio of the luminance of light that is emitted by the array light source 24 including the failure light emitting element without being subjected to the above-mentioned light correcting process relative to the luminance of light that is emitted by the array light source 24 that includes no failure light emitting element is referred to also as a luminance reduction rate prior to correction.

Here, suppose that, for example, one piece of the light emitting elements R (light emitting elements 41) has a failure among the array light source 24R of the image display apparatus 100-0 (master apparatus)(hereinafter, referred to as "circumstance A"). That is, supposed that one failure light emitting element is present in the array light source 24R. In this case, the luminance of light to be emitted by the array light source 24R including the one failure light emitting element becomes 5/6 of the luminance of light to be emitted by the array light source 24R including no failure light emitting element. That is, the luminance reduction rate prior to correction is 5/6.

In this case, the microcomputer 33 increases the luminance by increasing the electric current to be allowed to flow through five normal light emitting elements R.

In the luminance correction process under the above-mentioned circumstance A, the microcomputer 33 calculates a correction current value from the current-luminance characteristic LR1 and the adjusted current value IR0. More specifically, in the current-luminance characteristic LR1 of part (a) in FIG. 5, the microcomputer 33 calculates a correction current value IR1 by multiplying the current value IR0 by 6/5 that is an inverse of the above-mentioned 5/6. Then, in accordance with an instruction from the microcomputer 33, the light source control unit 27 controls the constant current circuits 61 corresponding to the respective normal light emitting elements R so as to set the current value of an electric current flowing through the five normal light emitting elements R to the correction current value IR1.

Thus, the luminance of light emitted by each of the five normal light emitting elements R becomes larger than YR0 by 6/5 times. That is, the luminance of light to be emitted by the array light source 24R becomes virtually the same as that prior to the occurrence of a failure light emitting element.

Additionally, a maximum value (hereinafter, referred to also as a maximum electric current value) of an electric current that the constant current circuit 61 allows to flow is preliminarily determined. For this reason, depending on the maximum electric current value of the constant current circuit 61, it is sometimes not possible to set the luminance of light emitted by the array light source 24 including a failure light emitting element to virtually the same as the luminance of light emitted by the array light source 24 including no failure light emitting element.

For example, suppose that one piece of light emitting elements R among six light emitting elements R has a failure. In this case, the luminance of light to be emitted by the array light source 24R becomes 5/6 of the luminance prior to the occurrence of the failure. In this case, suppose that the maximum current value of the constant current circuit 61 is $IR_{max}$ and that the current value of an electric current flowing through each of five normal light emitting elements R is controlled to $IR_{max}$ by using the above-mentioned light correction process.

In this case, as shown in part (d) in FIG. 5, R luminance corresponding to the maximum current value $IR_{max}$ is represented by YR0×(11/10). That is, the R luminance of the respective normal light emitting elements R is represented by YR0×(11/10). Consequently, the luminance of light to be emitted by the array light source 24R in accordance with the light correction process is represented by YR0×(11/10)×5/6=11/12, with the result that it is not returned to the luminance prior to the occurrence of the failure.

In such a case, the luminance correction process calculates a correction electric current value IG1 that sets the luminance of light to be emitted by the light emitting element G to YG0×(11/12) and a correction electric current value IB1 that sets the luminance of light to be emitted by the light emitting element B to YB0×(11/12).

Moreover, in the luminance correction process, the light source control unit 27 controls the constant current circuits 61 corresponding to the respective normal light emitting elements G so that the current value of an electric current flowing through each of the normal light emitting elements G of the array light source 24G is set to the correction electric current value IG1. Moreover, the light source control unit 27 controls the constant current circuits 61 corresponding to the respective normal light emitting elements B so that the current value of an electric current flowing through each of the normal light emitting elements B of the array light source 24B is set to the correction electric current value IB1. That is, the amount of electric currents to be allowed to flow through the normal light emitting elements is reduced.

With this arrangement, the luminance of white light formed by mixing R, G and B light rays is reduced by 11/12 times smaller than the luminance prior to the occurrence of the failure of the light emitting element. However, by maintaining the balance of R luminance, G luminance and B luminance in the same state as that prior to the failure, the chromaticity of white color becomes the same chromaticity prior to the occurrence of the failure. In this case, the luminance reduction rate pn calculated by a luminance reduction rate calculation process to be described later is 11/12.

As described above, even in the case where the luminance is lowered by an electric current limitation by the use of the maximum current value, a target value for luminance of the multi-screen 10A as a whole is re-set. For this reason, even when any one of light emitting elements has a failure, the homogeneity of chromaticity can be maintained among the respective images on the multi-screen 10A. That is, even in the case where any one of the light emitting elements has a failure with the result that the luminance values of RGB are not returned to those values prior to the failure due to current limitation, it is possible to maintain the chromaticity characteristic in the multi-screen 10A in the same state as that prior to the failure.

In the master apparatus and the slave apparatuses, after the luminance correction process, luminance reduction rate calculation processes (S122 and S222) for calculating the luminance reduction rate are carried out. In the luminance reduction rate calculation processes, the microcomputer 33 first calculates a corrected luminance based upon the current-luminance characteristic.

The corrected luminance refers to luminance of light emitted by the array light source 24 after the luminance correction process. The corrected luminance corresponds to luminance indicated by the current-luminance characteristic in association with the calculated correction current value. For example, in the case where the calculated correction current value is IR1, the corrected luminance is represented by YR0×(6/5) based upon the current-luminance characteristic LR1 of part (a) in FIG. 5.

Moreover, the microcomputer 33 calculates a value by multiplying the corrected luminance by (luminance reduction rate prior to the correction/initial luminance) as a luminance reduction rate pn.

The luminance reduction rate pn is correction information for use in homogenizing the luminance of light irradiated onto the multi-screen 10A over the entire area of the multi-screen 10A. Additionally, when a light correction process in the luminance correction process is carried out, the corresponding correction information (luminance reduction rate pn) is information relating to the light correction process.

More specifically, the luminance reduction rate corresponds to a ratio of luminance of light emitted by the array light source 24 including a failure light emitting element in accordance with the light correction process, relative to luminance of light emitted by the array light source 24 including no failure light emitting element.

For example, suppose that the initial luminance is YR0, the corrected luminance is YR0×(6/5) and the luminance reduction rate prior to the correction is 5/6. In this case, the luminance reduction rate pn, calculated by the luminance reduction rate calculation process, is represented by YR0×(6/5)×(5/6)/YR0, that is, 1.

In the slave apparatuses, after the luminance reduction rate calculation process, the microcomputer 33 transmits the calculated luminance reduction rate pn to the master apparatus (S223). That is, in the case where the light correction process in the luminance correction process is carried out, the slave apparatuses transmit the correction information relating to the light correction process to the master apparatus.

Thus, the master apparatus receives the luminance reduction rate pn as correction information.

That is, in the case where the microcomputer 33 (failure determination unit) of any one of the slave apparatuses determines that there is a failure light emitting element, the master apparatus acquires the luminance reduction rate pn (correction information) from the slave apparatus. In other words, in the case where the microcomputer 33 (failure determination unit) of any one of the slave apparatuses determines that there is a failure light emitting element, the master apparatus acquires the calculated luminance reduction rate from the slave apparatus as correction information.

Additionally, in the case where a light emitting element 41 inside the array light source 24 of the master apparatus has a failure, the failure light emitting element can be detected within the master apparatus. Therefore, the slave apparatuses having no failure light emitting element do not transmit the luminance reduction rate pn to the master apparatus. In the case where no luminance reduction rate pn is received, the master apparatus determines that there is no failure in the light emitting elements 41 in the slave apparatuses, and calculates a correction coefficient P to be described later, with the luminance reduction rate in the slave apparatuses being set to pn=1 (S131). The correction coefficient P corresponds to a correction instruction for use in homogenizing the luminance of light irradiated onto the multi-screen over the entire multi-screen.

In the case where a luminance reduction rate pn (correction information) is received, the master apparatus calculates a correction coefficient P based upon the acquired luminance reduction rate pn (correction information)(S131). In this case, the correction coefficient P corresponds to a coefficient for use in homogenizing the luminance of light to be irradiated to the multi-screen 10A over the entire multi-screen 10A. The correction coefficient P is calculated by the following equation 1:

$$P=(\text{luminance reduction rate pn of master apparatus})\times(\text{luminance reduction rate pn of slave apparatus}) \quad \text{(Equation 1)}$$

In the case where the luminance reduction rate of the master apparatus pn=11/12 and the luminance reduction rate of the slave apparatus pn=1, the correction coefficient P is P=11/12 from equation 1.

In step S131, in the case where step S121 is carried out or when step S223 is carried out based upon equation 1, the master apparatus forms a correction instruction (correction coefficient P). That is, in the case where the master apparatus carries out the light correction process or when the master apparatus receives correction information from the slave apparatus, the master apparatus forms the correction instruction (correction coefficient P) based upon at least one of the correction information relating to the light correction process carried out by the master apparatus and the received correction information.

The master apparatus transmits the calculated correction coefficient P to the slave apparatuses (S132). Thus, the slave apparatuses receive the correction coefficient P transmitted from the master apparatus (YES in S230). The correction coefficient P transmitted by the master apparatus corresponds to the correction instruction for use in controlling the slave apparatuses so as to homogenize the luminance of light to be irradiated onto the multi-screen 10A over the entire multi-screen 10A.

In other words, by transmitting the correction coefficient P to the slave apparatuses, the master apparatus controls the slave apparatuses so as to homogenize the luminance of light to be irradiated onto the multi-screen 10A over the entire multi-screen 10A.

In the master apparatus and the slave apparatuses, the microcomputer 33 determines whether or not P/pn=1 is satisfied in the ratio between the correction coefficient P and the luminance reduction rate pn (S140, S240). In the case where P/pn=1 is not satisfied, this state indicates that the luminance of light irradiated onto the multi-screen 10A is not homogenized over the entire multi-screen 10A.

When it is determined that P/pn=1 is satisfied (YES in S140 or S240), it is not necessary to alter the luminance. For this reason, the amount of an electric current flowing through the light emitting elements 41, which is controlled by the light source control unit 27, is not altered. In this case, in the master apparatus, the process proceeds to step S120, while in the slave apparatuses, the process proceeds to step S220.

In contrast, in the case where P/pn=1 is not satisfied, that is, in the case where the determination is made as (P/pn<1) (NO in S140 and S240), a luminance correction process A is carried out in the master apparatus and slave apparatuses (S141 and S241).

In the luminance correction process A, by altering the electric current flowing through the light emitting elements 41 in the respective array light sources 24R, 24G and 24B by using the light source control unit 27, the process for homogenizing the luminance of light to be irradiated onto the multi-screen 10A over the entire multi-screen 10A is carried out. More specifically, in the luminance correction process A, in the case where the luminance of light to be irradiated onto the multi-screen 10A is not homogenized over the entire multi-screen 10A, each of the master apparatus and slave apparatuses carries out the process for homogenizing the luminance of light to be irradiated onto the multi-screen 10A over the entire multi-screen 10A in accordance with the correction instruction (correction coefficient P).

Specifically, in the luminance correction process A, each of the light source control units 27 of the master apparatus and the slave apparatuses controls the array light sources 24 so as to homogenize the luminance of light be irradiated onto the multi-screen 10A over the entire multi-screen 10A based upon the correction coefficient P.

More specifically, by using the current-luminance characteristics of red light, green light and blue light rays and the adjusted current values IR0, IG0 and IB0 stored in the memory 34, the light source control unit 27 alters electric currents flowing through the respective light emitting elements 41 of the array light sources 24R, 24G and 24B.

In more detail, the light source control unit 27 controls the respective constant current circuits 61 inside the array light source 24R so as to set the current value of an electric current flowing through the light emitting elements 41 inside the array light source 24R to P/pn times as much as the IR0. In the case where P=11/12 and the luminance reduction rate pn=1 are satisfied, the current value of an electric current flowing through the light emitting elements 41 is controlled to be set to 11/12 times as much as the IR0.

In this case, the light source control unit 27 also carries out the same control as the above-mentioned control relating to the array light source 24R on the array light source 24G and the array light source 24B.

For example, supposed that, with respect to the correction coefficient P and the luminance reduction rate pn processed by the master apparatus, the correction coefficient P=11/12 and the luminance reduction rate pn=11/12 are satisfied. In this case, since P/pn=1, no luminance correction process A is carried out in the master apparatus.

Moreover, for example, supposed that, with respect to the correction coefficient P and the luminance reduction rate pn processed by the slave apparatuses, the correction coefficient P=11/12 and the luminance reduction rate pn=1 are satisfied. In this case, since P/pn<1, the luminance correction process A is carried out in the slave apparatuses.

After the luminance correction process A, the microcomputer 33 sets the value of the luminance reduction rate pn to a value of the latest correction coefficient P (S142, S242). In the case where P=11/12, the luminance reduction rate pn is set to 11/12. Thereafter, in the master apparatus, the process proceeds to S120. In the slave apparatuses, the process proceeds to step S220.

In this case, for example, suppose that failure light emitting elements are present in both of the slave apparatuses and master apparatus. In this case, in the slave apparatuses, processes of the aforementioned steps S221, S222 and S223 are carried out. Suppose that the luminance reduction rate pn of the slave apparatuses transmitted in step S223 is 11/12.

Moreover, in the master apparatus, the processes of the aforementioned steps S120, S121, S122, S131 and S132 are carried out. Here, suppose that the luminance reduction rate pn of the master apparatus calculated in step S122 is, for example, 4/6. Suppose that the correction coefficient P calculated in step S131 is 11/18. Then, in step S132, the master apparatus transmits the correction coefficient P to the slave apparatuses. In this case, in the master apparatus, processes of steps S140, S141 and S142 are further carried out.

Moreover, in the slave apparatuses, the aforementioned steps S230, S240, S241 and S242 are further carried out.

When it is determined by the failure determination unit of the slave apparatuses that there is a failure light emitting element, the master apparatus acquires correction information (luminance reduction rate pn) for use in homogenizing the luminance of light to be irradiated onto the multi-screen 10A over the entire multi-screen 10A from the slave apparatus. Moreover, in the case where the microcomputer 33 (failure determination unit) of the master apparatus determines that there is a failure light emitting element, the light source control unit 27 of the master apparatus controls the array light source 24 of the master apparatus so that the luminance of light to be irradiated onto the multi-screen 10A is homogenized over the entire multi-screen 10A, in accordance with the correction information (luminance reduction rate pn) received from the slave apparatuses. Moreover, the master apparatus also controls the slave apparatuses so as to homogenize the luminance of light to be irradiated onto the multi-screen 10A over the entire multi-screen 10A.

As described above, in accordance with the present preferred embodiment, by carrying out the above-mentioned luminance control process, even in the event of a failure light emitting element in at least one of the array light sources 24R, 24G and 24B, it is possible to minimize the degree of change in the luminance of R, G and B. That is, in the array light sources including the plurality of light emitting elements, even in the event of a failure light emitting element, it is possible to reduce the change in luminance of light to be emitted by the array light source.

Moreover, in the case where the luminance of light to be irradiated onto the multi-screen 10A is not homogenized over the entire multi-screen 10A, each of the master apparatus and the slave apparatuses carries out the process for homogenizing the luminance of light to be irradiated onto the multi-screen 10A over the entire multi-screen 10A.

Thus, it becomes possible to provide a multi-screen display apparatus that can maintain homogeneity of luminance among the respective screens of the multi-screen 10A.

Moreover, the above-mentioned structure makes it possible to maintain the chromaticity of a color made by mixing colors of red, green and blue at a constant level. That is, even in the case where one portion of the light emitting elements 41 has a failure, the luminance-chromaticity characteristic of the entire multi-screen 10A can be maintained. In other words, even when a light emitting element breaks down to become incapable of being lit up, it is possible to maintain the homogeneity of chromaticity and luminance among the respective screens 10 in the multi-screen 10A.

Moreover, even in the case where a difference occurs in luminance among the respective screens in the multi-screen 10A, the master apparatus calculates a correction coefficient, and the master apparatus and the respective slave apparatuses carry out the luminance correction process A based upon the correction coefficient so that the homogeneity of luminance can be maintained in the multi-screen 10A.

(Other Modified Examples)

In the above description, explanations have been given to a multi-screen display apparatus in accordance with the preferred embodiments; however, the present invention is not intended to be limited by these preferred embodiments. Those modified structures made by a person skilled in the art within the scope not departing from the gist of the invention are also included in the present invention. In other words, in the present invention, the preferred embodiments may be modified or omitted on demand within the scope of the invention.

For example, the multi-screen display apparatus 1000 is constituted by four image display apparatuses 100; however, this may be constituted by two or more image display apparatuses 100.

Moreover, not limited to a screen including a plurality of screens, the multi-screen 10A may be, for example, a multi-screen in which a plurality of screens of Braun tubes are combined with one another.

Furthermore, in the luminance correction processes in S121 and S221, the light source control unit 27 carries out a process for increasing an electric current flowing through the light emitting elements so as to correct a luminance lowered by a failure light emitting element; however, the present invention is not intended to be limited by this structure. For example, in the case where there is a failure in a light emitting element, only the luminance reduction rate may be calculated, that is, in the case where, for example, a light emitting element R has a failure, based upon the luminance reduction rate, by reducing an electric current flowing through the light emitting elements G and B, a controlling process may be carried out so as to maintain only the RGB chromaticity balance in a constant level.

In this case, the luminance of the entire multi-screen 10A of the multi-screen display apparatus 1000 is lowered in accordance with the number of failure light emitting elements. However, since the chromaticity balance can be maintained in a constant level, and since the electric current value is not increased with respect to the array light source 24 having a failure, it is possible to prevent a temperature rise and a shortened service life of the light emitting element due to an increase in electric current.

Moreover, in the case where a plurality of light emitting elements have a failure in a image display apparatus 100 of a multi-screen display apparatus, if the luminance reduction rate of the corresponding image display apparatus 100 is applied to the luminance of the entire multi-screen 10A, the luminance of the entire multi-screen 10A is greatly lowered to cause a possibility of difficulty in practical use.

In this structure, for example, in the case where four light emitting elements 41 of six light emitting elements 41 in the array light source 24R break down, a controlling process is carried out so as not to newly calculate a luminance reduction rate. Thus, the image display apparatuses 100 having no failure light emitting elements may be used without having a great reduction in luminance among those image display apparatuses 100.

Moreover, with respect to the image display apparatus 100 in which the luminance reduction rate is no longer calculated due to a plurality of failure light emitting elements, a corresponding on-screen display may be given or an alarm of an external control device or the like may be generated so that the necessity of repairing or exchanging light sources may be informed.

Furthermore, in the image display apparatus 100 in accordance with the above-mentioned preferred embodiment, the array light sources 24R, 24G and 24B of the three primary colors are used; however, array light sources of three primary colors or more colors may be used.

In the image display apparatus 100 in accordance with the above-mentioned preferred embodiment, a structure using three array light sources is adopted; however, the image display apparatus 100 is not limited by this structure, the image display apparatus 100 may have, for example, a structure in which one array light source and a color wheel are used so as to generate light rays of R, G, B, etc.

The image display apparatus 100 is not necessarily required for including all the components shown in FIG. 3.

That is, the image display apparatus 100 may include only the minimal necessary components capable of achieving the effects of the present invention. For example, the image display apparatus 100 may have a structure including only the screen 10, array light source 24, light source control unit 27 and failure determination unit (microcomputer 33).

Moreover, the present invention may be realized as a luminance control method having as its steps operations characterized by the structural unit prepared in the image display apparatus 100. Furthermore, the present invention may be realized as a program in which the respective steps included in such a luminance control method are executed by a computer. Alternatively, the present invention may be realized as a recording medium storing such a program, which can be read by a computer. Moreover, the corresponding program may be distributed through a transfer medium such as the Internet.

All the numeric values used in the above-mentioned preferred embodiment are exemplary numeric values for use in specifically explaining the present invention. That is, the present invention is not intended to be limited by the respective numeric values used in the preferred embodiment.

Moreover, the luminance control method relating to the present invention corresponds to the luminance control processes shown in FIG. 6. The luminance control method relating to the present invention is not necessarily required for including all the corresponding steps in FIG. 6. That is, the luminance control method relating to the present invention needs to include only the minimal steps required for achieving the effects of the present invention. For example, the luminance control method relating to the present invention may be a method which does not include the steps S110 and S210.

Moreover, the order in which the respective steps in the luminance control method are executed is only the exemplary order for use in specifically explaining the present invention, and an order other than the above-mentioned order may be used. Moreover, one portion of the steps in the luminance control method and another portion thereof may be executed independently in parallel with each other.

Additionally, one portion of the respective components of the image display apparatus 100 may be typically prepared as an LSI (Large Scale Integration) that is an integrated circuit. For example, the image input circuit 31, the image processing circuit 32 and the microcomputer 33 may be realized as integrated circuits.

In the present invention, within the scope of the invention, preferred embodiments may be modified or omitted on demand.

The present invention can be utilized as a multi-screen display apparatus which makes it possible to ensure homogeneity in luminance among respective screens in a multi-screen.

While the invention has been shown and described in detail, the foregoing description is in all aspects illustrative and not restrictive. It is therefore understood that numerous modifications and variations can be devised without departing from the scope of the invention.

What is claimed is:

1. A multi-screen display apparatus, which includes a first image display apparatus having a first screen and serving as a master apparatus and one or more second image display apparatuses, each having one of second screens and serving as a slave apparatus, and displays an image on a multi-screen constituted by said first screen and one or more said second screens, each of said first image display apparatus and said one or more second image display apparatuses comprising:

an array light source including a plurality light emitting elements for emitting light to be irradiated onto said multi-screen so as to display an image on said multi-screen;

a light source control unit that controls said plurality of light emitting elements so as to emit light; and a failure determination unit that determines whether or not there is a failure light emitting element that is a light emitting element having a failure among said plurality of light emitting elements, wherein when there is said failure light emitting element, said light source control unit carries out a light correction process for controlling the light emitting elements except for said failure light emitting element among said plurality of light emitting elements so as to allow luminance of light to be emitted by said array light source including the failure light emitting element to become closer to luminance of light emitted by said array light source prior to the occurrence of said failure light emitting element, wherein when said light correction process is carried out, said second image display apparatus transmits correction information relating to the light correction process to said first image display apparatus, wherein when said first image display apparatus carries out said light correction process, said first image display apparatus forms the correction instruction for use in homogenizing luminance of light to be irradiated to said multi-screen over the entire portion of said multi-screen, based upon said correction information relating to said light correction process carried out by said first image display apparatus, wherein when said first image display apparatus receives said correction information from said second image display apparatus, said first image display apparatus forms the correction instruction for use in homogenizing luminance of light to be irradiated to said multi-screen over the entire portion of said multi-screen, based upon said received correction information, wherein when luminance of light to be irradiated to said multi-screen is not homogenized over said entire multi-screen, each of said first image display apparatus and said second image display apparatuses carries out a process for homogenizing luminance of light to be irradiated to said multi-screen over said entire multi-screen in accordance with said correction instruction, and wherein each of said first image display apparatus and said one or more second image display apparatuses further comprises a constant current circuit that is installed in association with each of said light emitting elements, and wherein said light source control unit controls said constant current circuit so as to adjust the luminance of the light emitted by each one of said light emitting elements except for said failure light emitting element among said plurality of light emitting elements corresponding to the constant current circuit.

2. The multi-screen display apparatus according to claim 1, wherein said light emitting element is allowed to emit light when an electric current flows through the light emitting element, wherein each of said light source control units of said first image display apparatus and said second image display apparatuses carries out said light correction process by using a current-luminance characteristic indicating a relationship between an electric current flowing through said light emitting element and luminance of light emitted by the light emitting element, and wherein each of said first image display apparatus and said second image display apparatuses calculates a luminance reduction rate that is a ratio of luminance of light emitted by said array light source including said failure light emitting element in accordance with said light correction process relative to luminance of light emitted by said array light source including no failure light emitting element.

3. The multi-screen display apparatus according to claim 2, wherein when said failure determination unit of said second image display apparatus determines that said failure light emitting element is present, said first image display apparatus acquires said calculated luminance reduction rate from said second image display apparatus as said correction information.

4. The multi-screen display apparatus according to claim 1, wherein said array light source comprises a red light source for emitting red light, a green light source for emitting green light and a blue light source for emitting blue light.

5. The multi-screen display apparatus according to claim 1, wherein said light emitting element is an LED (Light Emitting Diode).

6. A luminance control method, which is carried out by a multi-screen display apparatus that includes a first image display apparatus having a first screen and serving as a master apparatus and one or more second image display apparatuses, each having one of second screens and serving as a slave apparatus, and displays an image on a multi-screen constituted by said first screen and one or more said second screens, each of said first image display apparatus and said one or more second image display apparatuses comprising:

an array light source including a plurality light emitting elements for emitting light to be irradiated onto said multi-screen so as to display an image on said multi-screen; and a light source control unit that controls said plurality of light emitting elements so as to emit light, said luminance control method comprising the steps of:

determining whether or not there is a failure light emitting element that is a light emitting element having a failure among said plurality of light emitting elements, wherein when there is said failure light emitting element, allowing said light source control unit to carry out a light correction process for controlling the light emitting elements except for said failure light emitting element among said plurality of light emitting elements so as to allow luminance of light to be emitted by said array light source including said failure light emitting element to become closer to luminance of light emitted by said array light source prior to the occurrence of said failure light emitting element;

when said light correction process is carried out, allowing said second image display apparatus to transmit correction information relating to said light correction process to said first image display apparatus;

when said first image display apparatus carries out said light correction process, allowing said first image display apparatus to form the correction instruction for use in homogenizing luminance of light to be irradiated to said multi-screen over the entire portion of said multi-screen, based upon said correction information relating to said light correction process carried out by said first image display apparatus, when the first image display apparatus receives said correction information from said second image display apparatus, allowing said first image display apparatus to form the correction instruction for use in homogenizing luminance of light to be irradiated to said multi-screen over the entire portion of said multi-screen, based upon said received correction information, and when luminance of light to be irradiated to said multi-screen is not homogenized over said entire multi-screen, allowing each of said first image display apparatus and said second image display apparatuses to carry out a process for homogenizing luminance of light to be irradiated to said multi-screen over said entire multi-screen in accordance with said correction instruction, and wherein each of said first image display apparatus and said one or more second image display apparatuses further comprises a constant current circuit that is installed in association with each of said light emitting elements, and wherein said light source control unit controls said constant current circuit so as to adjust the luminance of the light emitted by each one of said light emitting elements except for said failure light emitting element among said plurality of light emitting elements corresponding to the constant current circuit.

* * * * *